United States Patent [19]

Bujese

[11] Patent Number: 5,006,899

[45] Date of Patent: Apr. 9, 1991

[54] DEVELOPING SYSTEM FOR AN ELECTROPHOTOGRAPHIC MULTICOLOR IMAGING APPARATUS

[75] Inventor: David P. Bujese, Butler, N.J.

[73] Assignee: Olin Hunt Specialty Products Inc., Cheshire, Conn.

[21] Appl. No.: 403,642

[22] Filed: Sep. 6, 1989

[51] Int. Cl.[5] ..... G03G 15/10

[52] U.S. Cl. ..... 355/256; 355/326

[58] Field of Search ..... 355/326, 327, 328, 256

[56] References Cited

U.S. PATENT DOCUMENTS

| | | | |
|---|---|---|---|
| 3,958,876 | 5/1976 | Terashima | 355/327 |
| 4,033,688 | 7/1977 | Orthmann | 355/327 X |
| 4,082,443 | 4/1978 | Draugelis | 355/326 |
| 4,358,195 | 11/1982 | Kuehnle et al. | 355/4 |
| 4,547,061 | 10/1985 | Weber et al. | 355/10 |
| 4,600,669 | 7/1986 | Ng et al. | 430/47 |
| 4,611,901 | 9/1986 | Kohyama et al. | 355/326 X |
| 4,708,459 | 11/1987 | Cowan et al. | 355/4 |
| 4,789,612 | 12/1988 | Haneda et al. | 355/326 X |
| 4,841,336 | 6/1989 | Kusumoto et al. | 355/245 |

*Primary Examiner*—A. T. Grimley
*Assistant Examiner*—Sandra L. Hoffman
*Attorney, Agent, or Firm*—Ralph D'Alessandro

[57] ABSTRACT

An improved developing system for an electrophotographic color imaging apparatus is disclosed which selectively moves multiple individual developing units from a plurality of first storage positions to the same working or operating position in a processing path to color develop the latent image. The developing system stores the individual developing units remotely from the processing path. The individual toner developing units move in both horizontal and vertical directions as they move from the first storage positions to the second working or operating position. The working position is the same distance and time from the charging and depressant coronas in the process path that is followed to produce a colored image.

36 Claims, 4 Drawing Sheets

DEVELOPING SYSTEM FOR AN ELECTROPHOTOGRAPHIC MULTICOLOR IMAGING APPARATUS

BACKGROUND OF THE INVENTION

This invention relates generally to liquid electrophotographic colored imaging apparatus. More specifically, it relates to an improved developing system for applying color toner from a plurality of individual developing units to a charged latent image.

Original artworks, such as photographs, hand or machine drawn advertising, computer generated images or hand drawn pictures are usually converted from continuous tone to half-tone or dot matrix format to be able to easily reproduce the artwork on a printing press. Color original artworks are generally separated into four half-tone color separations simply known as separations. Each half-tone separation has one of the four colors of the artwork applied to the image thereon. It is possible to convert original color artwork into more than four color separations, which may be achieved in a number of ways known in the art. These may include the use of a camera utilizing different color filters with the illuminated art object, or with a graphics art scanner.

Traditionally, the separations have been formed on silver films and a color proof image, commonly known as a proof, is produced from the separation films and is visually compared to the original artwork. The separations are then judged or compared with the original artwork to determine acceptability of reproduction. A successful color proof then has the image of each separation reproduced by known techniques on a separate printing plate that is typically formed of an aluminum sheet with an organic film coating. The printing plates are then employed to successively print the images onto a receiving substrate such as paper, metal, plastic, or fabric.

Various commercial proof generating equipment is available, such as that offered by the 3M Company under the tradename "Color-Key". This system utilizes pre-pressed proofing materials with pre-sensitized ink pigment coatings in either transparent or opaque colors on transparent polyester base sheets. Each primary color and black base sheet is overlayed by its associated separation negative and after exposure and development the four Color-Key, sheets are overlayed and registered to provide a proof or simulation of what the four-color work will look like when printed.

Another commercially employed pre-press color proofing system is also marketed by the 3M Company under the trade name "Transfer-Key" and is intended to provide a complete four-color proof on a single sheet. In this system, precoated carrier sheets of color pigment bearing the primary cyan, yellow, magenta and black pigments are successively laminated onto the base material by use of a specially developed laminator. This system employs a lamination/exposure/development cycle that is repeated for each color to produce the four-color proof. Each carrier sheet is first laminated to the base material, then exposed to the particular color separation negative, and then developed in a specially developed processor.

A third system commercialized by the 3M Company for color proofing is sold under the "Matchprint II" which is alleged to employ the advantages of "Transfer-Key" proofs, but utilizes a single level of optical gain in order to attempt to accurately simulate the press gain encountered in high-speed printing publication.

Another commercially available pre-press color proofing system is that sold by the E.I. Dupont de Nemours Company under the tradename "Cromalin." This system employs a master film that is sticky on its exposed surface and which, when selectively exposed to light, becomes hardened and nonsticky in the exposed areas. pigment toners are then rubbed onto the surface and adhere in the sticky areas to form a layer of developed image.

Numerous other color proofing systems have been commercially used, such as the Coulter color proofing system that uses a low voltage, high charge density electrophotographic material with submicron resolution and high edge acutance in both analog and digital imaging models. This system employs a cadmium sulfide electrically anisotropic crystalline photoconductor on a metal base. Essentially this same system is currently used by Stork. Another system that has recently been introduced is the Kodak "Signature" system which uses an electrophotographic color proofing apparatus to generate half-tone color separations derived from a piece of artwork and comprises the steps of charging, exposing and developing.

All of these previous electrophotographic systems use a development technique, however, which suffers from the disadvantages of not being able to maintain the same physical distance between locations for the charging of the latent image and its development at each toner development station and not being able to prevent cross contamination of the toners from adjacent toners. Previous electrophotographic systems with multiple toner developing station locations also experience varied levels of drying of the liquid toners on the surface of the photopolymer master or photoconductor between the developing and transfer stations because of the different distances between each of the multiple individual developing stations and the single transfer station along the processing path. Uniform developing times were achievable in prior art systems, but only with variable developing speeds. Additionally, most of the prior commercial color proofing apparatus has been of substantial size and also lacked the versatility and the ability to easily increase the number of colors employed without increasing the floor space.

These problems are solved in the design of the color imaging apparatus of the present invention utilizing an improved development system that has individual development units that are moveable between, a plurality of locations in a first storage position and a single common second operating developing position.

SUMMARY OF THE INVENTION

It is an object of the present invention to provide an electrophotographic color imaging apparatus that utilizes a single common development location for each of the plurality of separate and individual color developing units.

It is another object of the present invention to provide an improved developing system that utilizes transportable individual color developing units in an electrophotographic color imaging apparatus.

It is a feature of the present invention that each of the plurality of individual color developing units is selectively moveable between a first storage position remote from the processing path and the common second operating position that is in the processing path of the latent image.

It is another feature of the present invention that the improved developing system is employable in an electrophotographic color imaging device that employs either a photopolymer master or a photoconductor as the medium in which the latent image for the color toning is formed.

It is still another feature of the present invention that each individual color developing unit has its own development electrode, its own color toner supply line, and its own reverse roller to remove any excess liquid toner applied to the latent image by the development electrode.

It is another feature of the present invention that each toner supply line and each excess toner drain line associated with each of the plurality of individual development units have quick disconnect fittings to facilitate rapid and easy development unit replacement for maintenance or system expansion to employ a greater number of colors.

It is yet another feature of the present invention that each individual development unit engages the drive mechanism for the reverse roller only when transported to the second operating position, which is the single common development location for the improved development system.

It is an advantage of the present invention that the potential for cross contamination of the liquid color toners from the surface of the photoconductor or photopolymer master with the developed latent image is eliminated.

It is another advantage of the present invention that the physical distance between the locations for the charging of the latent image and the developing of the latent image is the same for each color toner that is applied to the latent image and, therefore, the time between charging and developing the latent image is the same for each color.

It is still another advantage of the present invention that the processing path length of the color imaging apparatus is decreased, along with the decrease in the actual processing time required to produce the colored image.

It is yet another advantage of the present invention that the production throughout the electrophotographic color imaging apparatus with the improved development system is increased.

It is another advantage of the present invention that the overall size or footprint of the electrophotographic multicolor imaging apparatus is reduced.

It is still another advantage of the present invention that the distance between the second operating position and the transferring apparatus, as well as the time between developing the latent image with each color and the transferring of the developed color image to a receiving surface, is the same.

These and other objects, features and advantages are obtained in the improved development system of the present invention in a liquid electrophotographic color imaging apparatus which selectively transports multiple individual developing units from a plurality of locations in a first storage position to the same working or operation position along a processing path to permit color development of the latent image to occur. The developing system stores the individual developing units remotely from the processing path.

DETAILED DESCRIPTION OF THE PREFERRED EMBODIMENT

Figure 1:
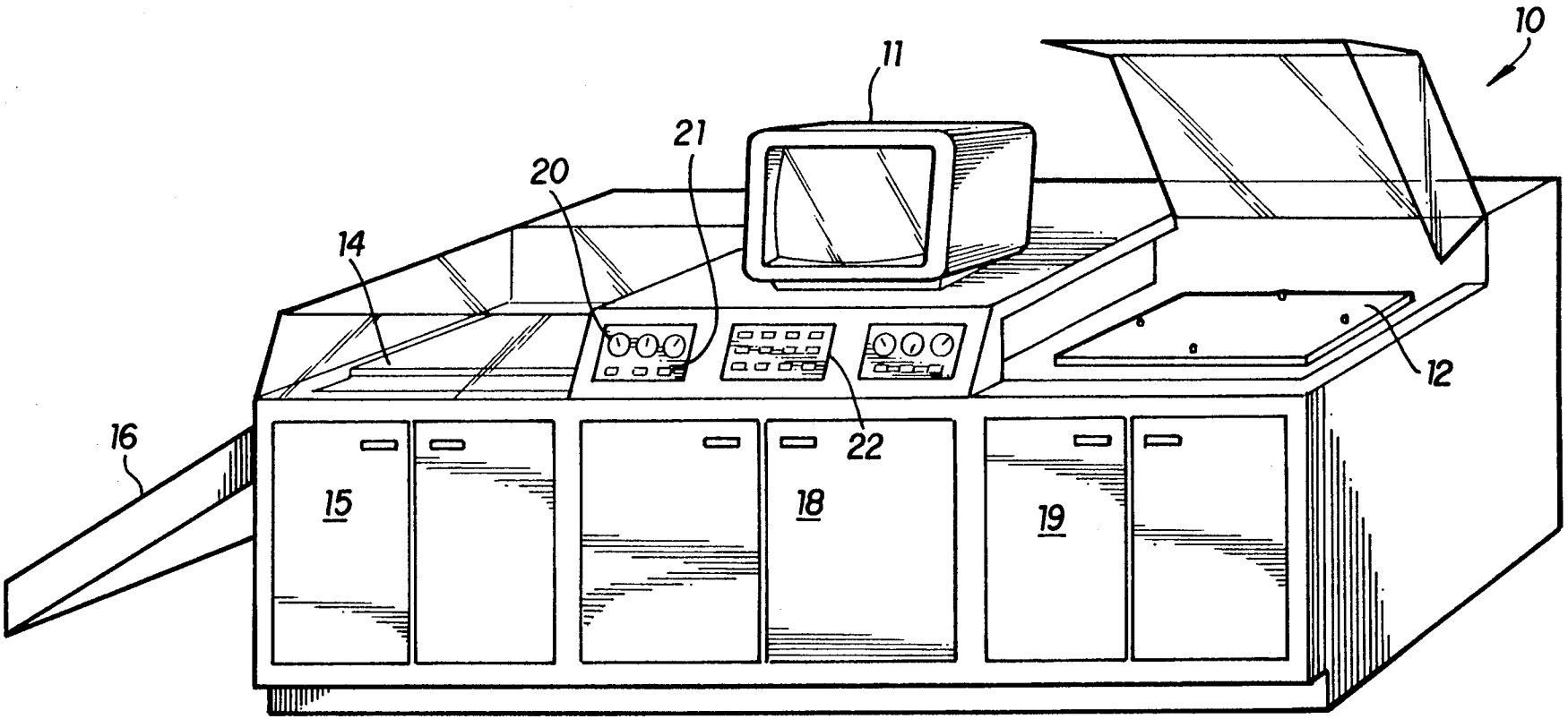
FIG. 1 is front perspective view of the electrophotographic color imaging apparatus.
Figure 3:
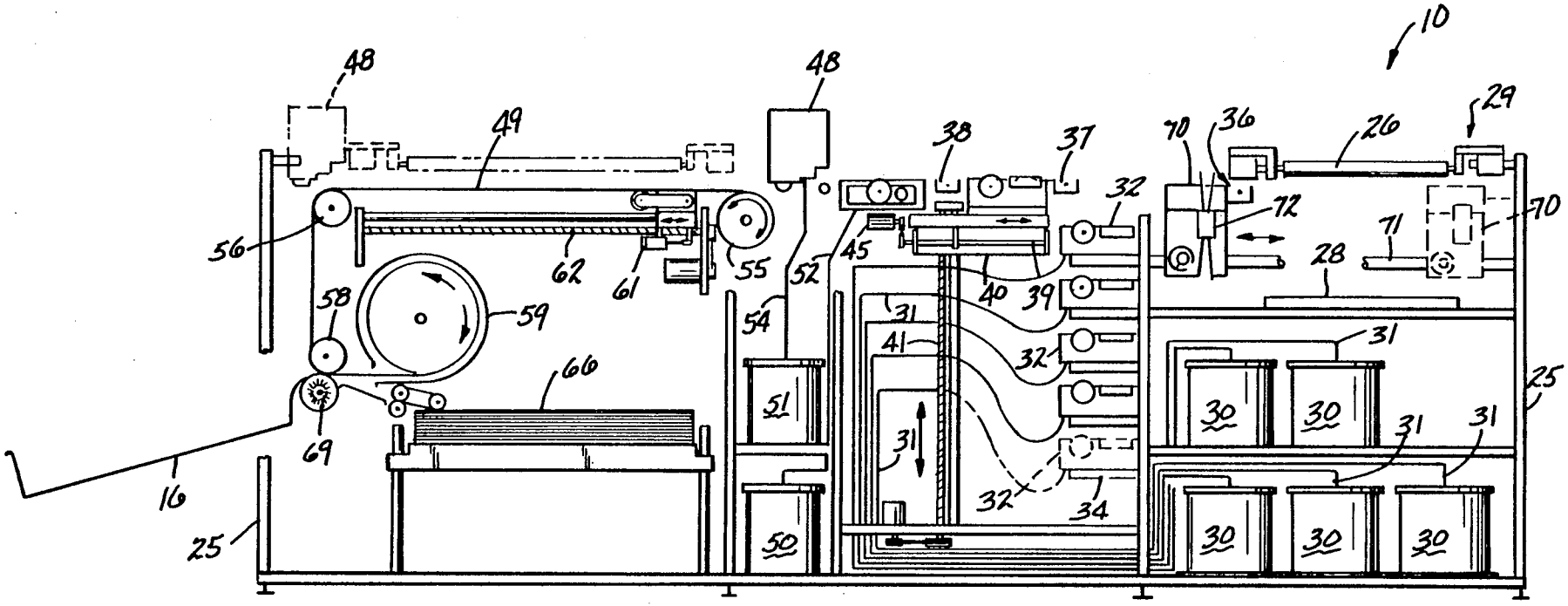
FIG. 3 is a front elevational view of an electrophotographic color imaging apparatus adapted for use with a photoconductor employing an analog exposure unit.
Figure 4:
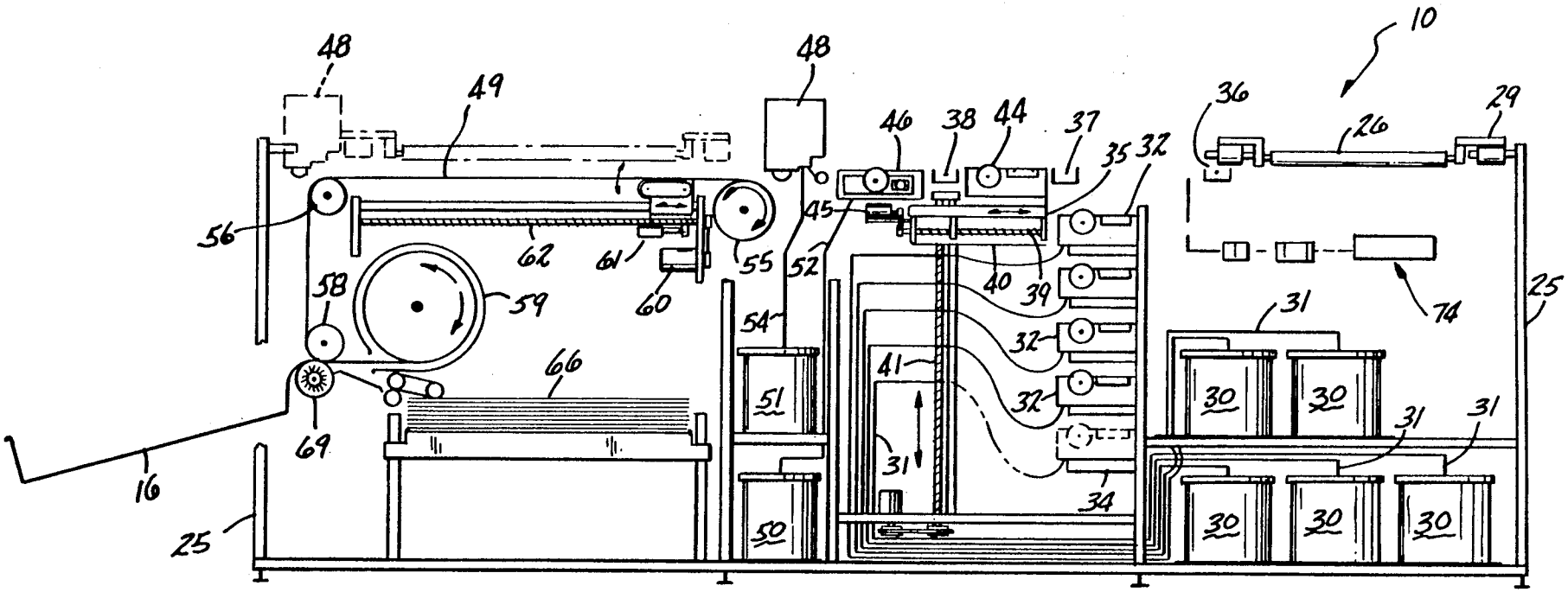
FIG. 4 is a front elevational view of an electrophotographic color imaging apparatus adapted for use with a photoconductor employing a digital exposure unit.

FIG. 1 shows in perspective view the electrophotographic multicolor imaging apparatus, indicated generally by the numeral 10. Imaging apparatus 10 includes a monitor 11 that is used to control the diagnostics for sequential operation and processing, as well as being able to display a color menu and a dot gain menu. An imaging station 12 is provided for use with a photopolymer master with the detailed apparatus shown in FIG. 2. The imaging station 12 can also utilize a photoconductor with an analog exposure system as shown in FIG. 3 where a color separation is employed. Alternately, a laser imaging unit can be employed in a digital exposure system as shown in FIG. 4.

An image transfer station 14 is shown, below which proofing paper is contained within the compartment behind access doors 15 and to feed out the proofed paper to the retaining tray 16. Access doors 18 provide access to the developing and cleaning stations, while access doors 19 provide entry to the colored toner storage tanks.

The plurality of adjustable control knobs, which are indicated generally by the numeral 20 in FIG. 1, are used to control the charge corona voltage for both negative and positive charges, the bias voltage to each development electrode, antideposition voltage to each development electrode to permit toner to be repelled off of the electrode, the AC discharge voltage, and the transfer voltage. The plurality of switches 21 which underly the adjustable control knobs 20 are used for the main power shut off, the start cycle, vacuum switch and color toner selector switches. A monitor panel 22 is employed to monitor proper air pressure and vacuum pressure, give indications of toner tank levels and the operation of positive or negative corona charging units.

Figure 2:
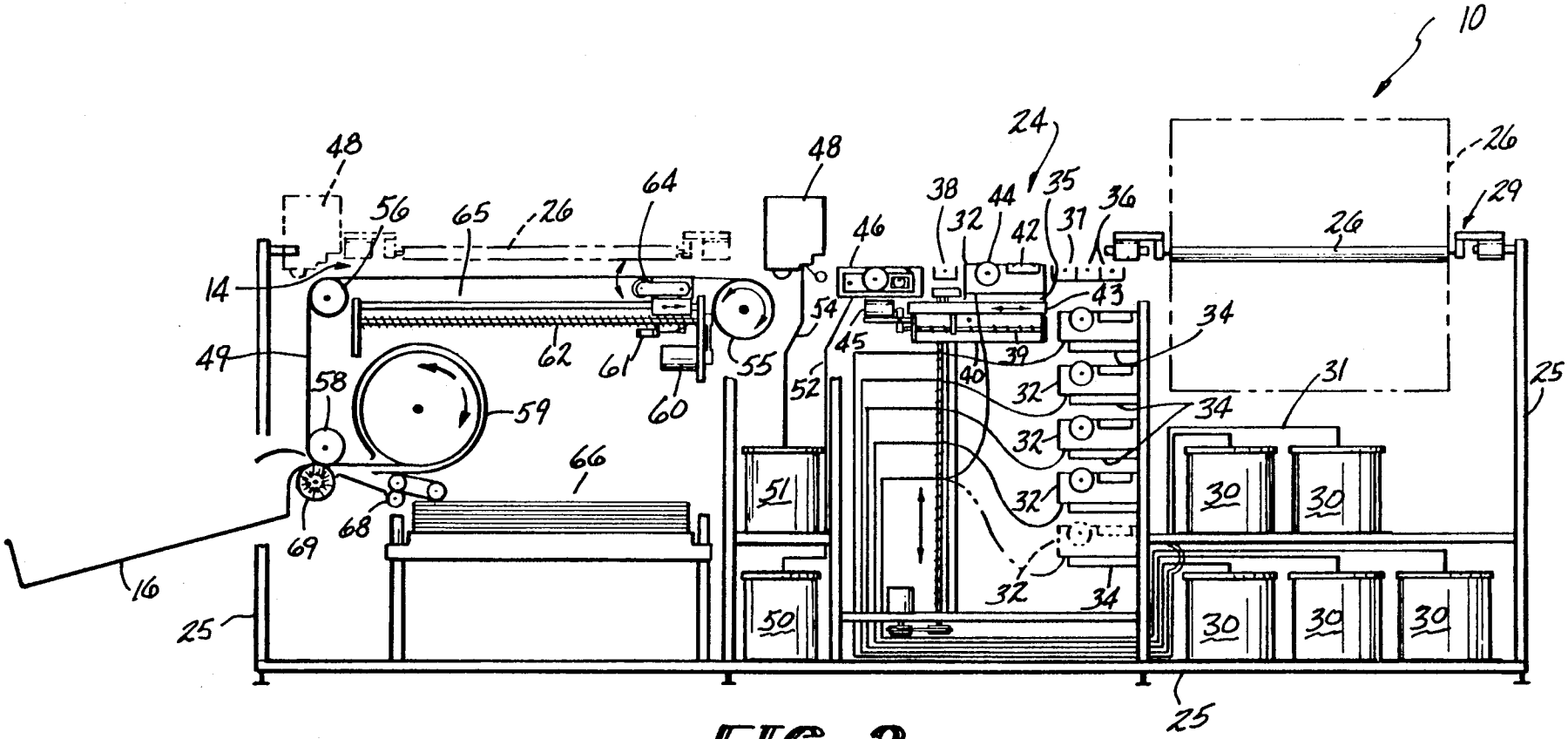
FIG. 2 is a front elevational view of the electrophotographic color imaging apparatus of FIG. 1 with the cover panels removed adapted for use with a photopolymer master with a permanent latent image attached to a vacuum platen and showing the improved development system with one individual color development unit shown in the second operating position and its remote first storage position shown in phantom lines while the remaining nonselected color development units remain in their remote first storage positions.

FIG. 2 shows the color imaging apparatus with its cover panels removed, revealing the improved developing station with the color file storage system of the present invention indicated generally by the numeral 24. A frame 25 supports the operating components of the color imaging apparatus 10. A rotatable platen 26 is shown in dotted lines in a raised position and in its operating generally horizontal position in solid lines. The platen 26 can be used to retain a flexible or rigid photoconductor on which the latent image is formed and charged or a permanent photopolymer master in which the permanent latent image already exists and is then charged. As seen in FIG. 3, a support table 28 is used to hold the color separation artwork in an analog exposure system. In all systems, the master image transport assembly, indicated generally by the numeral 29, moves reciprocatingly between the solid line and the dotted line positions along the processing path.

Beneath the master image transport assembly 29 of FIGS. 2 and 4 and the separation artwork support table 28 and the platen 26 of FIG. 3 are the colored toner storage tanks indicated generally by the numeral 30. Colored toners can, for example, be black, cyan, magenta, yellow or any other desired colors. Toner supply lines 31 flow from each of the individual tanks to the individual developing units 32 that are included within the color file storage system of developing system 24.

The individual color toner developing units 32 have their supply lines 31 moveably connected so that the lines move with the developing units from their first storage position on individual storage trays 34 to the common second operating position shown as position 35 in the processing line intermediate the charging coronas 36, the discharge corona 37 and the depressant or suppressant corona 38. Each toner supply line and their accompanying excess toner drain lines (not shown) have quick disconnect fittings to allow the toner development units to easily be replaced.

As can be seen in FIG. 2, the individual developing units 32 move first horizontally by means of a drive screw 39 that extends and retracts a support shelf 43 from a transport unit 40 that removes and replaces individual developing units 32 from the storage trays 34. The transport unit 40, with the developing unit 32, is moved generally vertically by a second drive screw 41. Horizontal and vertical drive screws 39 and 41 are motor driven by drive motors 45 and 47, respectively, such as with chain and sprocket drives (not shown) utilizing a slip clutch on the drive sprocket. The drive gear mechanism (not shown) rotates the reverse roller 44 in each individual developing unit 32 and is engaged only when the unit is transported to the second operating position 35. After the drive gear mechanism is engaged, the development electrode 42 is activated and feeds out the liquid color toner. The reverse roller 44 is utilized, after the charged image on the photoconductor is transported over the developing station and is developed, to remove the excess toner surrounding the developed image. Alternately, a stationary air knife located along the processing path intermediate the depressant corona 38 and the second operating position 35 may be employed in place of the reverse roller in each individual developing unit 32.

Once the charged latent image that is in the photoconductor or photopolymer master retained by the platen 26 has been toned by being passed over the second operating position 35, the first color toning unit 32 is returned to its remote first storage position on storage tray 34 prior to the transport of the second color toner individual developing unit 32 from the first storage position to the common second operating position 35. This sequential movement of the individual developing units 32 between the first storage position and the common second operating position 35 is selectively controlled until all of the desired color toners have been applied to the charged latent image for each color separation and sequentially transferred to a substrate, such as paper or plastic, or to an intermediate transfer belt for ultimate transfer to the desired substrate.

A cleaning station 46 is provided to clean the toned image after transfer has occurred at the image transfer station 14. Cleaning station 46 is moved between a raised operative position and a lowered nonworking position so that it does not interfere with the image developing and transfer operations. The individual development units 32 remain in their first storage positions during the cleaning operation to prevent retoning of the photoconductor or photopolymer master. The individual development units 32 return to their first storage positions prior to the return of the master image transport assembly 29 to its solid line position in FIGS. 2–4 and the initiation of the cleaning operation.

Located adjacent the cleaning station 46 is the wicking station 48, which moistens., the transfer web 49. Web 49 is preferably a fluorosilicone coated belt. Wicking station 48 moves with the master transport assembly 29 to the dotted line position shown overlying the transfer station 14. Supply tanks 50 and 51 are connected to the cleaning station 46 and the wicking station 48, respectively by supply lines 52 and 54.

The image transfer station 14 has the transfer belt wound about rollers 55, 56, 58 and the toner prefusing heating roller 59. A motor drive mechanism (not shown), rolls the belt 49 up and about the toner prefusing heater roller 59. Drive mechanism 60 is employed to power drive screw 62 to cause the transfer roller 64 to move reciprocatingly along track 65. The transfer roller 64 is actuated up against the bottom of the belt 49 by an air cylinder 61 to accomplish liquid gap image transfer from the fully toned image on the photoconductor to the belt 49. This image transfer by the transfer roller 64 across the liquid-filled gap between the belt 49 and the toned image is accomplished as described in U.S. Pat. Nos. 4,879,184 issued Nov. 7,1989 and 4,894,686 issued Jan. 16, 1990, both assigned to the assignee of the present invention and herein specifically incorporated by reference in pertinent part.

Once the plural developed color separation images comprising the colored image have been transferred to the belt 49, the colored image is transferred to proofing paper 66 by the paper being fed by roller mechanism 68 through the nip formed between heated fusing roller 69 and roller 58. This transfer is a contact transfer from the belt 49 to the receiving paper 66. The finished proofs are stored in paper retaining tray 16.

In operation, the color imaging apparatus 10 has a platen 26 that retains either a photoconductor or a photopolymer master on which the latent image is created. The latent image can be created in one of three ways, depending on whether the system uses a permanent photopolymer master as in FIG. 2 that exposes a photopolymer to actinic radiation through color separation artwork placed on top of the photopolymer surface to create the permanent latent image for each color separation, or an analog exposure system such as that shown in FIG. 3, or a digital exposure system such as that shown in FIG. 4. The analog exposure system of FIG. 3 charges and then exposes the photoconductor by scanning the color separation placed on the color separation support 28 with a charging and exposure unit 70 that traverses along track 71. The separation has its image illuminated by an exposure lamp 73 and the illuminated image is exposed onto the photoconductor through the lens 72 of FIG. 3. Where a digital exposure unit, such as that seen in FIG. 4, is employed the images created by the laser imaging unit 74 image-wise expose the photoconductor that is retained on platen 26.

Thereafter, regardless of whether a laser imaging or analog exposure system is employed, the photoconductor is transported by the master transport assembly 29 across the discharge corona 37 to the common second operating position 35 in the developing system 24. The individual developing units 32 are sequentially transported from their first storage positions on trays 34 to the common second operating position 35 by means of the horizontal and vertical drive screws 39 and 41. The developing unit support shelf 40 has a drive mechanism (not shown) that is engaged when each individual developing unit 32 is in the second common operating position 35 so that the reverse roller 44 is operative.

Each developing electrode 42 has its own biasing voltage so that the voltage can be tailored to each individual toner's charging and developing characteristics. Once the photoconductor has been fully developed with a selected color toner, it passes over the depressant corona 38 and proceeds with the wicking station 48 to the transfer belt 49 at image transfer station 14. The wicking station 48 moistens the transfer belt 49 and the toned color image is transferred from the photoconductor across the liquid-filled gap to the transfer belt 49. After all of the color separation images are developed with their appropriate color toners and are superimposed in sequential transfers to the transfer belt 49, the image then is transferred to the color proofing paper 66 by contact transfer at the nip formed between the roller reel 58 and the heated fusing roller 69. The finished color proof is stored in tray 16.

While the preferred structure in which the principles of the present invention have been incorporated is shown and described above, it is to be understood that the invention is not to be limited to the particular details thus presented but, in fact, widely different means may be employed in the practice of the broader aspects of this invention. For example, this development system apparatus is equally well employable for color proofing or color printing. The colored toner can equally well all be superimposed on one photoreceptor surface and then transferred in one step to either a transfer belt for ultimate transfer to the receiving paper or could be transferred directly to the receiving paper. The transfer may be either an electrostatic or contact transfer or a heat lamination transfer from a flexible photoreceptor. The photoconductor employed can be any one selected from the group consisting of cadmium sulfide, zinc-cadmium sulfide mixtures, zinc oxide-resin mixtures, selenium and selenium alloys, or other suitable organic photoconductors. The improved color development system of the instant invention can also be used in color proofers or printers that use a photoconductor drum, or a drum to mount the flexible photopolymer master or the flexible photoconductors in place and bring the individual developing units 32 to the drum. The development electrode 42 in each individual developing unit 32 would be arcuately shaped to conform to the circumference of the drum and the master which is to be developed. Alternately, a flexible photoconductor or a photopolymer master could be mounted to a flexible web or belt in apparatus employing the instant invention's improved color development system. The photoconductor could also be rigid and mounted to a supporting platen or an integral part of the supporting platen, such as selenium or cadmium sulfide, where it is coated or vapor deposited on to the supporting platen. The scope of the appended claims is intended to encompass all obvious changes in the details, materials and arrangements of parts that will occur to one of ordinary skill in the art by a reading of this disclosure.

What is claimed is:

1. A multicolor imaging apparatus having an improved developing system for applying color toner to a charged latent image, comprising in combination:

(a) means for providing the charged latent image:

(b) a plurality of individual developing units each adapted to contain a different color toner for developing the latent image, all of the individual developing units being retained in a first remote storage position, each developing unit being selectively moveable between the first remote storage position and a common second operating position in a processing path adjacent the charged latent image, the second operating position being the same for the plurality of developing units; and (c) means to selectively transport all of the plurality of developing units between each of the first remote storage positions and the common second operating position.

2. The apparatus according to claim 1 wherein the plurality of developing units in the first storage position are stored at different heights with respect to each other.

3. The apparatus according to claim 2 wherein the plurality of developing units in their first storage positions are stored generally vertically with respect to each other.

4. The apparatus according to claim 1 or 2 wherein the plurality of developing units in the first storage position are stored at different positions with respect to each other in a generally horizontal direction.

5. The apparatus according to claim 1 wherein the plurality of developing units in the first storage position are stored in different positions with respect to each other along a generally horizontal axis.

6. The apparatus according to claim 1 wherein charging means are positioned adjacent the second operating position of the plurality of developing units, the distance between the charging means and the second operating position being the same for each developing unit.

7. The apparatus according to claim 6 wherein transfer means to transfer a developed color image from the developed, latent image to a receiving surface is spaced apart from the second operating position, the distance between the transfer means and the second operating position being the same for each developing unit.

8. The apparatus according to claim 7 wherein cleaning means are positioned intermediate the transfer means and the second operating position.

9. The apparatus according to claims 2 or 5 wherein each individual developing unit further comprises a color toner applying unit.

10. The apparatus according to claim 9 wherein each color toner applying unit further includes a color toner development electrode.

11. The apparatus according to claim 10 wherein each individual developing unit further comprises a reverse roller.

12. The apparatus according to claim 11 wherein each individual developing unit further comprises a wiper means to remove excess toner from the reverse roller.

13. The apparatus according to claim 10 wherein the toner is a liquid toner.

14. The apparatus according to claim 8 wherein the latent image is on a photoreceptor.

15. The apparatus according to claim 14 wherein the photoreceptor is on a cylindrical drum.

16. The apparatus according to claim 14 wherein the photoreceptor is a flexible photoconductor.

17. The apparatus according to claim 16 wherein the flexible photoconductor is selected from the group consisting of an organic photoconductor, cadmium sulfide, zinc-cadmium sulfide mixtures, zinc oxide-resin mixtures, selenium and selenium alloys.

18. The apparatus according to claim 16 wherein the flexible photoconductor is on a flat platen.

19. The apparatus according to claim 14 wherein photoreceptor is a rigid photoconductor.

20. The apparatus according to claim 8 wherein the latent image is a permanent latent image retained in a photopolymer master.

21. The apparatus according to claim 8 wherein suppressive charging means are positioned along the processing path adjacent the second operating position so that the distance between the suppressive charging means and the second operating position of the plurality of developing units is the same for each developing unit.

22. A method of applying a plurality of colored toners to a plurality of corresponding charged latent images in a multicolor imaging apparatus comprising the steps of :

(a) storing all of a plurality of colored toners in a plurality of developing units in a first storage position, each toner being stored separately and remote from a processing path;

(b) placing a charged latent image from a selected color separation adjacent a second operating position in the processing path;

(c) moving a first one of the plurality of colored toners in its developing unit from the first storage position to the second operating position;

(d) developing the charged latent image by applying colored toner from the first of the colored toner developing units to the image;

(e) moving the first of the plurality of colored toner developing units from the second operating position back to the first storage position; and (f) repeating steps (b)-(e) a plurality of times each time with a different color toner developing unit and a selected color separation latent image corresponding to the selected color toner in the different color toner developing unit to create a full-toned color image.

23. The method according to claim 22 further comprising the step of moving the individual color toner developing units generally horizontally and then generally vertically from the first storage position to the second operating position.

24. The method according to claim 22 further comprising positioning the second operating position for each developing unit the same distance from charging means in the processing path.

25. The method according to claim 23 further comprising positioning transfer means to transfer a developed color image from the developed latent image to a receiving surface adjacent the second operating position, the distance between the transfer means and the second operating position being the same for each developing unit.

26. The method according to claim 24 further comprising positioning suppressive charging means adjacent the second operating position so that the distance between the suppressive charging means and the second operating position is the same for each developing unit.

27. The method according to claim 24 further comprising positioning the charged latent image adjacent the second operating position so that the distance between the charged latent image and the second operating position is the same for each developing unit.

28. The method according to claim 27 further comprising positioning a color toner development electrode in each developing unit so that the distance between the charged latent image and the color toner development electrode in the second operating position is the same for each developing unit.

29. The method according to claim 27 further comprising positioning a reverse roller adjacent the color toner development electrode in each developing unit so that the distance between the charged latent image and the color toner development electrode and the reverse roller in the second operating position is the same for each developing unit.

30. The method according to claim 22 further comprising using a flexible photoconductor or a flexible photopolymer master as the surface in which the charged latent image is formed.

31. The method according to claim 22 further comprising using a rigid photoconductor as the surface in which the charged latent image is formed.

32. The method according to claim 22 further comprising returning the individual developing units from the second operating position to the first storage position prior to cleaning residual colored toner from the developed charged latent image.

33. The method according to claim 22 further comprising transferring the developed charged latent image after each developing step to a receiving surface.

34. The method according to claim 33 further comprising transferring the developed latent images repetitively in superposition onto the receiving surface to form a superimposed full color image.

35. The method according to claim 34 further comprising transferring the superimposed full color image to a final receiving surface.

36. The method according to claims 34 or 35 further comprising fusing the superimposed full color image to the final receiving surface.

* * * * *